US006045356A

United States Patent [19]

Hunter et al.

[11] Patent Number: 6,045,356

[45] Date of Patent: Apr. 4, 2000

[54] GAS BURNER AND FABRICATION METHOD FOR SAME

[75] Inventors: Richard M. Hunter; Paul A. Boyle, both of Lexington; Daniel E. Newman, Georgetown, all of Ky.

[73] Assignee: Monessen Hearth Systems, Inc., Paris, Ky.

[21] Appl. No.: 09/167,358

[22] Filed: Oct. 7, 1998

[51] Int. Cl.[7] ..... F23D 13/40

[52] U.S. Cl. ..... 431/354; 431/125; 29/890.02; 126/512

[58] Field of Search ..... 126/92 R, 92 AC, 126/41 R, 512, 91 R; 431/125, 126, 354; 239/553.3, 600, 553.5; 29/890.02; D7/407

[56] References Cited

U.S. PATENT DOCUMENTS

| | | | |
|---|---|---|---|
| D. 368,829 | 4/1996 | Giebel et al. | D7/407 |
| D. 369,517 | 5/1996 | Ferlin | D7/407 |
| D. 369,720 | 5/1996 | Giebel et al. | D7/407 |
| 3,837,789 | 9/1974 | Schindler et al. | 431/354 |
| 3,874,839 | 4/1975 | Riehl | 431/354 |
| 4,838,241 | 6/1989 | Rieger | 126/92 |
| 4,890,601 | 1/1990 | Potter | 126/512 |
| 4,971,031 | 11/1990 | Richardson | 126/512 |
| 5,033,455 | 7/1991 | Eiklor et al. | 126/512 |
| 5,249,958 | 10/1993 | Freber | 431/354 |
| 5,263,852 | 11/1993 | Beck | 431/125 |
| 5,320,520 | 6/1994 | Barth et al. | 431/125 |
| 5,328,356 | 7/1994 | Hawkinson | 431/125 |
| 5,399,084 | 3/1995 | McCullough et al. | 431/125 |
| 5,406,703 | 4/1995 | Haen et al. | 29/890.02 |
| 5,601,073 | 2/1997 | Shimek | 126/512 |
| 5,645,409 | 7/1997 | Ni et al. | 431/8 |
| 5,671,727 | 9/1997 | Squires et al. | 126/512 |

*Primary Examiner*—James C. Yeung
*Attorney, Agent, or Firm*—Woodard, Emhardt, Naughton Moriarty & McNeff

[57] ABSTRACT

A gas burner for a fireplace includes a rectangular, unitary pan which is fabricated from a generally rectangular single sheet metal panel. Prior to forming the panel into the pan, an inlet tube hole and gas ports are machined into the panel. Assembled to the unitary pan is a gas inlet tube with an air adjustment sleeve assembled thereto. An optional baffle may be used and the purpose of the baffle is to reduce the back firing of gas. The fabrication steps for converting the flat sheet metal panel into the unitary pan involve forming first and second long edges with specific bend geometries and then folding the panel so as to bring those formed edges into alignment with each other. Those formed edges are then crimped together. Once this is completed, each shorter side edge is then folded to itself and crimped so that on three sides of the unitary pan there are crimped seams which are leak-free and along the fourth side there is a fold. The fabrication steps remain the same regardless of the starting panel size, thereby adding to the versatility and design flexibility of the present invention.

13 Claims, 5 Drawing Sheets

GAS BURNER AND FABRICATION METHOD FOR SAME

BACKGROUND OF THE INVENTION

The present invention relates in general to gas burner designs for use as part of a residential vented or vent-free fireplace. More specifically, the present invention relates to gas burner designs of a pan or shell style where the focus is on the construction simplicity and efficiency. In the present invention, the focus is also on the versatility and the fabrication method which permits a wide range of size variations without any significant changes in the fabrication tooling. Accordingly, the method of manufacturing the present invention gas burner and the required tooling for such manufacturing are important considerations.

Traditionally, the burners for gas fireplaces, usually residential, have been of the "tube-type" design. More recently, newer gas burners have been produced in a pan style which may also equivalently be referred to as a shell style. The pan or shell style of gas burner, as contrasted to a tube-type burner, offers greater versatility in the form, size, and positioning of the gas ports. The pan style of gas burner can be combined with a fiber ceramic log set in order to produce the desired aesthetic effects.

Considering earlier pan style gas burners, the typical construction involves utilizing a plurality of sheet metal members or components. In contrast, the present invention incorporates a one-piece shell for a pan style gas burner. A novel and unobvious manufacturing method is used to produce the gas burner of the present invention. The one-piece shell can be produced at a reduced cost relative to multiple-piece shells and this enables greater manufacturing flexibility. In the context of the present invention, the one-piece construction is for the pan of the gas burner. A separate component piece is required for the gas inlet tube which is fitted into one side or one sheet metal panel of the one-piece pan in order to deliver gas to the hollow interior and from there to the gas ports which are located in another, opposite side or sheet metal panel of the pan.

SUMMARY OF THE INVENTION

A gas burner for a fireplace according to one embodiment of the present invention comprises a unitary pan having a fold along a first edge and a crimped seam along a second, opposite edge, the unitary pan having a hollow interior and defining a plurality of gas ports which are in flow communication with the hollow interior, the gas ports being positioned between the first edge and the second, opposite edge. Included as part of the present invention is a gas inlet tube which is assembled into the unitary pan and is in flow communication with the hollow interior.

One object of the present invention is to provide an improved gas burner for a fireplace.

Related objects and advantages of the present invention will be apparent from the following description.

DESCRIPTION OF THE PREFERRED EMBODIMENT

Figure 1:
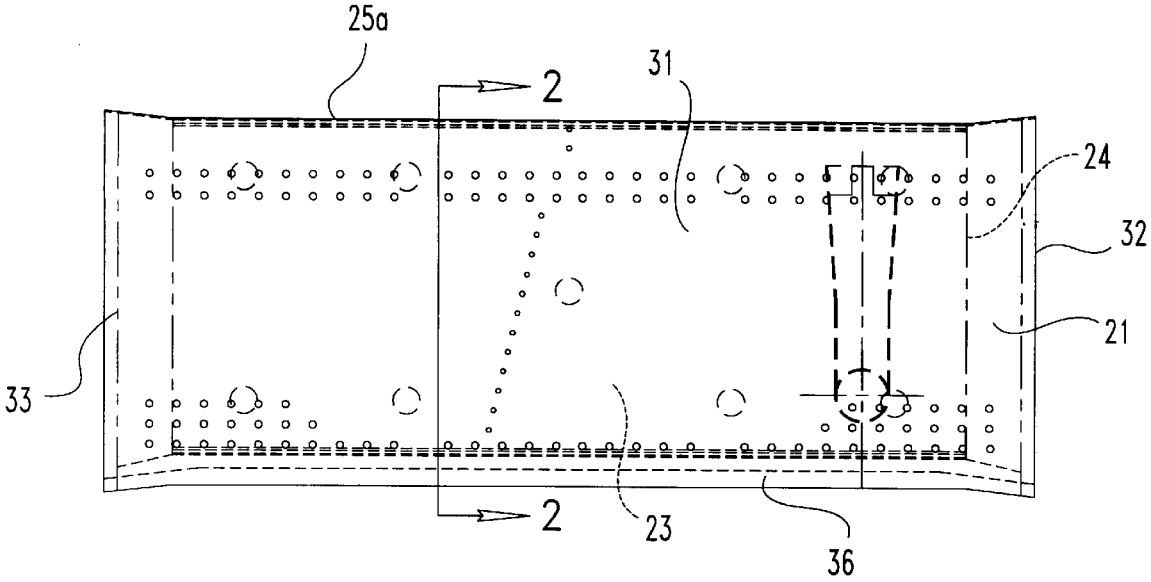
FIG. 1 is a top plan view of a gas burner for a fireplace according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
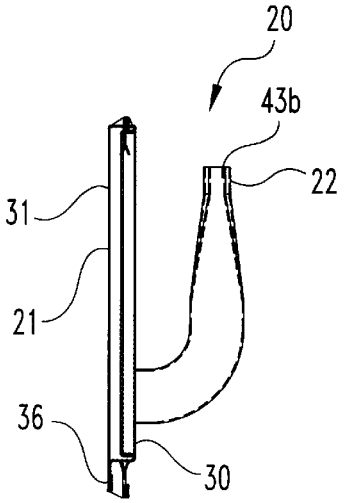
FIG. 2 is a side elevational view of the FIG. 1 gas burner.
Figure 2A:
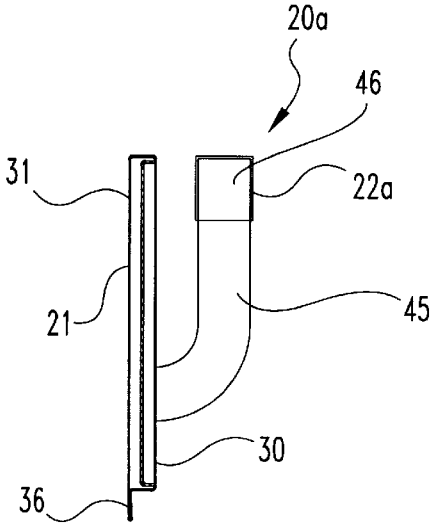
FIG. 2A is a side elevational view of the FIG. 1 gas burner with an alternative gas inlet tube.
Figure 3:
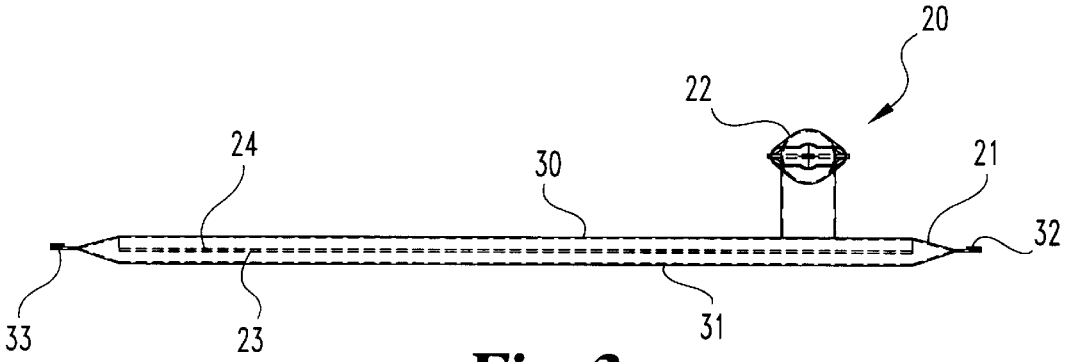
FIG. 3 is a front elevational view of the FIG. 1 gas burner.
Figure 4:
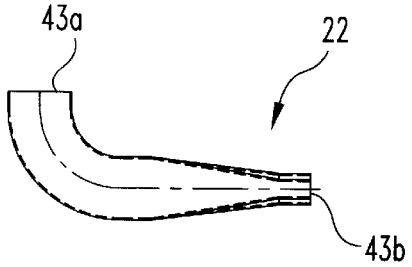
FIG. 4 is a front elevational view of a gas inlet tube which comprises one component of the FIG. 1 gas burner.
Figure 5:
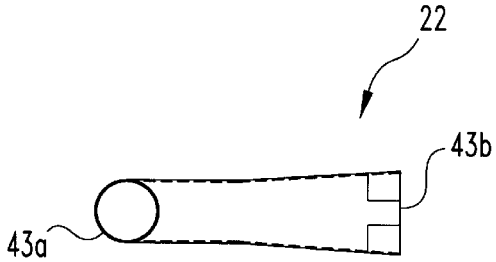
FIG. 5 is a top plan view of the FIG. 4 gas inlet tube.
Figure 6:
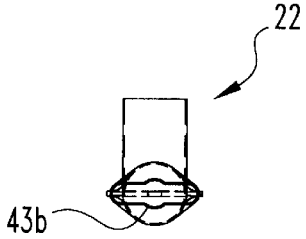
FIG. 6 is an end elevational view of the FIG. 4 gas inlet tube.
Figure 4A:
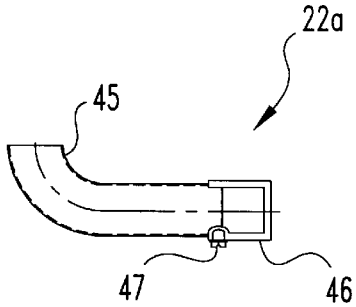
FIG. 4A is a front elevational view of an alternative gas inlet tube which comprises one component of the FIG. 1 gas burner.
Figure 5A:
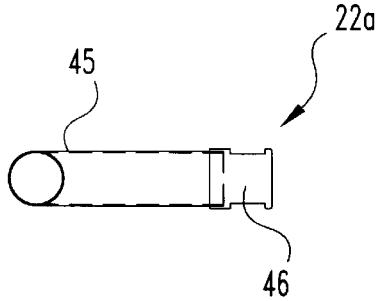
FIG. 5A is a top plan view of the FIG. 4A gas inlet tube.
Figure 6A:
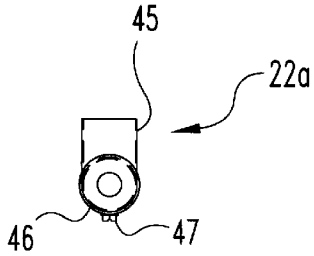
FIG. 6A is an end elevational view of the FIG. 4A gas inlet tube.
Figure 7:
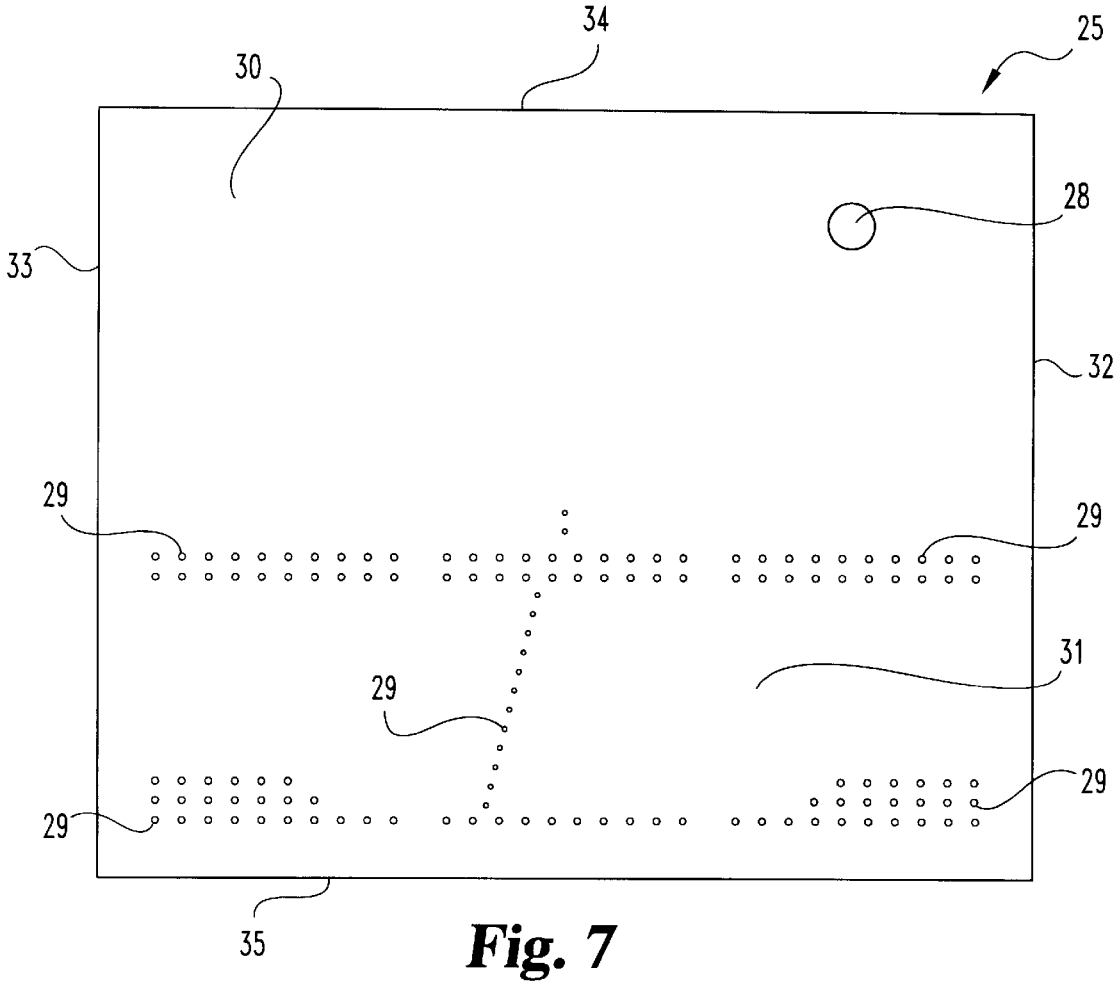
FIG. 7 is a top plan view of the starting sheet metal panel which is fabricated into the unitary pan of the FIG. 1 gas burner.
Figure 8:
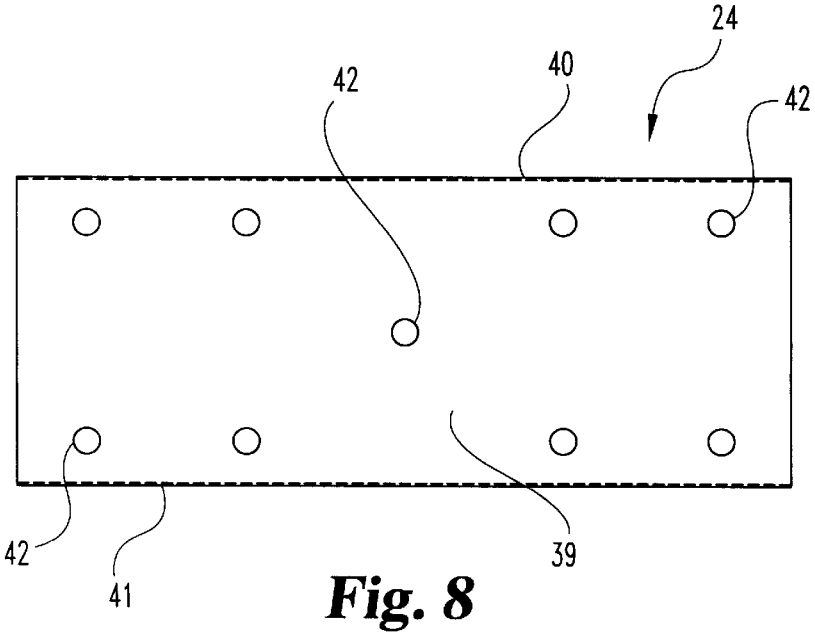
FIG. 8 is a top plan view of a baffle which may be optionally included as part of the FIG. 1 gas burner according to the present invention.
Figure 9:
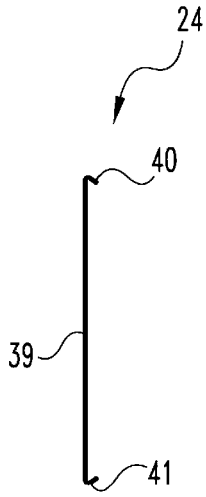
FIG. 9 is an end elevational view of the FIG. 8 baffle.
Figure 12:
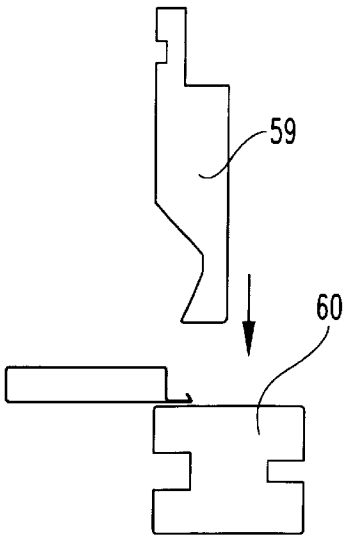
FIG. 12 is a diagrammatic illustration of the third fabrication step for converting the FIG. 7 panel into a unitary pan for the FIG. 1 gas burner, including the associated tooling.

Referring to FIGS. 1, 2, and 3, there is illustrated a gas burner 20 which is constructed with a unitary pan 21 and a gas inlet tube 22. Also illustrated in the hollow interior 23 of the unitary pan 21 is an optional baffle 24. The details of fixed gas inlet tube 22 are illustrated in FIGS. 4–6. The details of adjustable gas inlet tube 22*a* are illustrated in FIGS. 4A, 5A, and 6A. FIG. 2A shows the form of the gas burner 20*a* when gas inlet tube 22*a* is used. The starting unitary sheet metal panel 25, which is fabricated into pan 21, is illustrated in FIG. 7. The details of baffle 24 are illustrated in FIGS. 8 and 9. The manufacturing or fabrication steps for converting panel 25 into unitary pan 21 and the diagrammatic representations of the associated tooling are illustrated in FIGS. 10–15.

Unitary pan 21 begins as a flat sheet metal panel 25 (see FIG. 7) into which a 1.0 inch diameter hole is punched for receipt of a gas inlet tube, either tube 22 or tube 22*a*. A series of smaller holes 29 are punched into panel 25 in the pattern shown. This pattern creates the desired or selected flame pattern for the burner when it is placed in a vented or vent-free fireplace. The hole pattern is selected based upon fireplace size and shape as well as on the size and style of the artificial logs which are being used in the fireplace. When panel 25 is folded in order to begin the fabrication steps leading up to unitary pan 21, the gas inlet hole 28 is located in one side (side 30) of the pan and the pattern of smaller holes 29 (gas ports) located in the opposite side (side 31) of the pan.

After the panel 25 is folded, its various side edges, including edge 32, edge 33, edge 34, and edge 35 are formed and crimped in such a manner so as to establish leak-free seams around the perimeter of pan 21. Due to the rectangular shape of panel 25, the location of the initial fold 25*a*, and the fact that the fold 25*a* is parallel to edges 34 and 35 enables edge 32 to be folded onto itself as is also the case with the opposite edge 33. Edges 34 and 35 are brought into alignment with each other by the folding step and ultimately edge 34 is crimped to edge 35 in order to form lip 36. As is explained in detail with regard to the fabrication steps of FIGS. 10–15, the shaping or forming of edges 34 and 35 is performed prior to the folding of panel 27. If the optional baffle 24 is going to be used as a means to reduce the back firing of gas, the formed baffle is assembled into the hollow interior 23 of pan 21 after edges 34 and 35 are crimped together to form lip 36, but prior to the crimping of edge 32 onto itself and prior to the crimping of the opposite edge 33 onto itself. As should be clear from the drawing illustrations, once lip 36 is formed by crimping together formed edges 34 and 35, the sides or ends of pan 21 denoted by folded edges 32 and 33, respectively, are open. This open condition along edges 32 and 33 provides a clearance space for baffle 24 to be inserted. Due to the flat and relatively shallow nature of baffle 24, it is capable of sliding into the hollow interior of pan 21 between either folded edges 32 or between folded edges 33. Pan 21 has a nominal thickness of 0.50 inches. The thickness of baffle 24 is approximately 0.25 inches. Once a decision is made with regard to baffle 24, the two thicknesses of edge 32, which has been folded onto itself, are folded together and this second fold is then crimped in order to provide a leak-free seam. The final step is then to fold the two thicknesses of edge 33 and crimp the folded thickness to provide a leak-free seam at that location. The manner in which edges 34 and 35 are formed means that the crimping of those two edges together into lip 36 will establish a leak-free seam along that edge as well. The fourth side is where the fold 25*a* to panel 25 is located and thus that would obviously be leak-free as well.

Referring to FIGS. 8 and 9, baffle 24 has a flat panel main body 39 with opposite folded edges 40 and 41. The fold angle for the two edges 40 and 41 is approximately 53 degrees. Edges 40 and 41 establish the thickness of baffle 24 and the spacing for main body 39 between the two sides of panel 21. The nine holes 42 in baffle 24 allow the gas from tube 22 (or tube 22*a*) to flow through the interior of pan 21 in a somewhat evenly distributed flow pattern so that the flame pattern by way of holes 29 is also evenly distributed relative to the artificial logs and this balances the flame pattern across the width of the fireplace with the desired flame pattern which has been selected for the particular fireplace.

With reference to FIGS. 4, 5, and 6, the fixed gas inlet tube 22 is illustrated in greater detail. Tube 22 is a hollow sleeve with a first opening 43*a* which is substantially cylindrical in form and an opposite end, second opening 43*b* which has a tapered form in the FIG. 4 illustration and a flared form in the FIG. 5 illustration. In FIG. 6, the shaped and contoured end configuration of second opening 43*b* is illustrated. The fixed air opening 43*b* has a minimum air opening of 0.407 square inches.

With reference to FIGS. 4A, 5A, and 6A, the adjustable gas inlet tube 22*a* is illustrated in greater detail. Tube 22*a* is actually an assembly of three components including the main tube 45 which is a stainless steel tube with a 0.028 inch wall thickness bent at one end with an inside radius of curvature of 0.75 inches. The opposite end is configured to receive sleeve 46 which provides an adjustable air opening (primary air shutter) for the inflow of primary air in order to blend with the gas for combustion. A set screw 47 is used to securely fix the air opening size once it is selected so that it will not move due to handling and/or vibrations. By turning sleeve 46 relative to main tube 45, the size of the air opening can be changed. In the preferred embodiment, the air opening ranges from a minimum of 0.094 square inches (in two places) up to a maximum of 0.473 square inches (in two places). The main tube 45 has a 1.0 inch outside diameter and hole 28, into which the main tube 45 is inserted, has a 1.0 inch inside diameter. This means a line-to-line fit (nominal). In order to anchor either fixed gas inlet tube 22 or the adjustable inlet tube (assembly) 22*a* into the unitary pan 21, fabrication techniques such as brazing, welding, or swaging, can be used. It is also contemplated that the tube can be joined to the pan by other mechanical attachment methods.

The fabrication steps for forming sheet metal panel 25 into unitary pan 21 are illustrated in FIGS. 10–15. The associated tooling is diagrammatically illustrated and while the actual tooling would have a more complex configuration, the basic forming steps are what are being illustrated and a general appreciation for what type of tooling can be used is sufficient.

Figure 10:
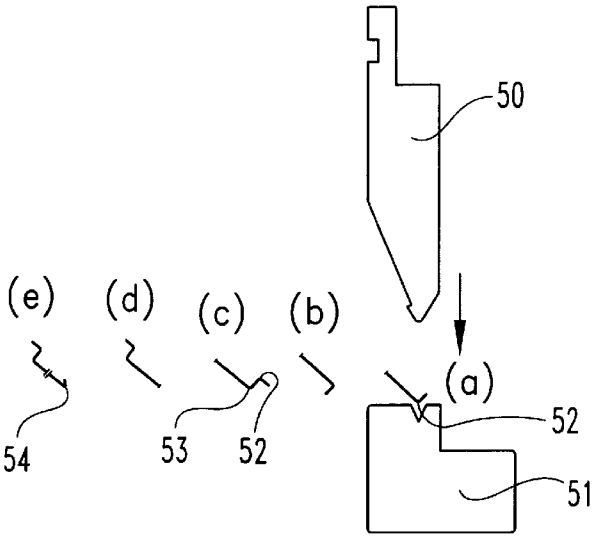
FIG. 10 diagrammatically illustrates a first fabrication step for converting the FIG. 7 panel into a unitary pan for the FIG. 1 gas burner, including diagrammatic representations of the associated tooling.

The fabrication of pan 21 starts with metal panel 25 and begins with step I which is illustrated in FIG. 10. Step 1 involves the forming of edge 35 with a double bend and the forming of edge 34 with a single bend. The diagrammatic illustration of FIG. 10 shows panel 25 in partial form. At this point in the fabrication sequence, the inlet tube hole 28 and the gas port holes 29 have been punched (or machined) into panel 25 by means of a turret machine.

In step 1, as illustrated in FIG. 10, a brake press (bar) 50 is used in cooperation with a forming die 51. In substep (a) of step 1, edge 35 is placed between the brake press 50 and the cooperating die 51 and a first bend 52 is made. The panel 25 is then flipped over and in substep (b) of step 1, a second bend 53 is made in panel 25 adjacent edge 35. The resulting configuration is shown in substep (c) of step 1. In substep (d) of step 1, the panel 25 is rotated in order to position edge 34 between the brake press 50 and the cooperating die 51. A single bend 54 is formed along edge 34 in substep (e) of step 1.

Figure 11:
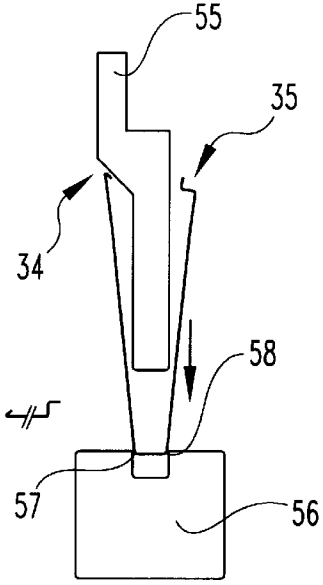
FIG. 11 is a diagrammatic illustration of the second fabrication step for converting the FIG. 7 panel into a unitary pan for the FIG. 1 gas burner, including the associated tooling.

The second main fabrication step is illustrated in FIG. 11. Brake press 55 and cooperating die 56 are used to bend panel 25 with two bends, 57 and 58, which results in folding the panel onto itself such that the bends along edges 34 and 35 are brought into alignment with each other.

In order to create lip 36, edge 35 with the double bend is fitted within the fold created by single bend 54. In step 3, edge 34 is flattened so as to capture edge 35 (see FIG. 12). By means of the flattening or crimping step which captures edge 35, a leak-free seam is created for lip 36 which is the long edge of the unitary pan. A third style of brake press 59 is used in cooperation with a third style of forming die 60 for the step 3 procedure. The baffle 24 can be added at any time before both shorter, side edges 32 and 33 are flattened.

Figure 15:
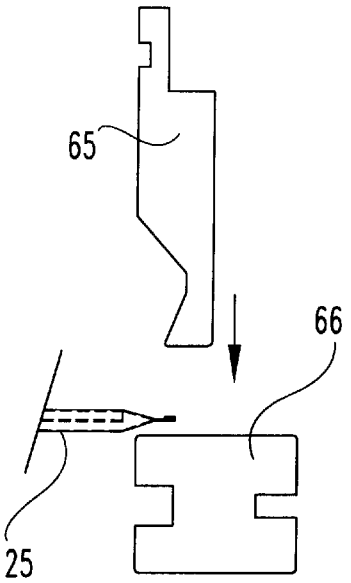
FIG. 15 is a diagrammatic illustration of the sixth fabrication step for converting the FIG. 7 panel into a unitary pan for the FIG. 1 gas burner, including the associated tooling.
Figure 14:
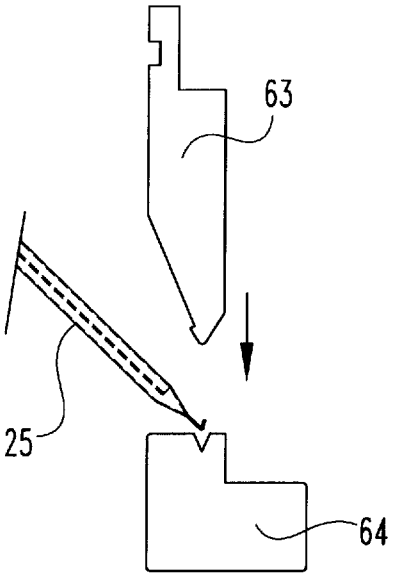
FIG. 14 is a diagrammatic illustration of the fifth fabrication step for converting the FIG. 7 panel into a unitary pan for the FIG. 1 gas burner, including the associated tooling.
Figure 13:
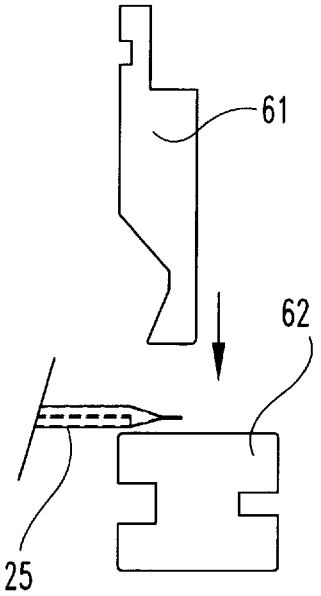
FIG. 13 is a diagrammatic illustration of the fourth fabrication step for converting the FIG. 7 panel into a unitary pan for the FIG. 1 gas burner, including the associated tooling.

The next step which is illustrated in FIG. 13 is to flatten both halves of edge 32 onto itself and to flatten both halves of edge 33 onto itself. As illustrated in FIG. 7, panel 25 includes opposite edges 32 and 33 which are folded onto themselves as part of step 2. In effect, the full length of each edge is folded into two portions which are aligned. The double bend in panel 25 at step 2 creates a type of wedge-shaped gap between the two portions of edge 32 and the same occurs for edge 33. The flattening step thus flattens the wedge and brings to the two portions of edge 32 together as well as bringing the two portions of edge 33 together. In this manner, there is a double thickness of panel material along each edge. Brake press 61 and die 62 are used for this flattening step. 33. Brake press 63 and die 64 are used for this step. The final (i.e., sixth) step (see FIG. 15) is to flatten the bends so that the flattened and bent side edges 32 and 33 are each crimped into a corresponding leak-free seam. Since the side edges 32 and 33 are each first folded onto themselves and then bent, the crimped seam along each edge or side is comprised of four thicknesses of panel material. Brake press 65 and cooperating die platform 66 are used for this final step as illustrated in FIG. 15.

What has been described herein as a unitary pan is also known as a one-piece shell, but regardless of the selected or preferred terminology, it is cost effective to produce and provides significant design flexibility. This design flexibility can be found by being able to easily vary the size of the unit and in being able to selectively choose or select the number of gas ports as well as the pattern or positioning of the gas ports (holes 29). These two variables can be combined in a variety of configurations in order to produce the desired aesthetic effects when used in conjunction with a fiber ceramic log set.

With a one-piece (unitary) design which is manufactured from turret and brake press machines, an infinite number of different sizes and gas port patterns are available. The tooling which is used fixes only the one-half inch thickness of pan 21, but allows the other length and width dimensions to be varied. The porting of the burner is completely flexible using a turret machine.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A gas burner for a fireplace comprising:

a unitary pan having a fold along a first edge, a crimped seam along a second, opposite edge, a first side seam between said first edge and said second, opposite edge and an opposite second side seam between said first edge and said second, opposite edge, said unitary pan having a hollow interior and defining a plurality of gas ports which are in flow communication with said hollow interior, said gas ports being positioned between said first edge and said second, opposite edge;

a gas inlet tube assembled to said unitary pan and being in flow communication with said hollow interior; and a baffle positioned in said hollow interior and being constructed and arranged to reduce any backfiring of gas.

2. The gas burner of claim 1 wherein said plurality of gas ports are arranged in two spaced-apart substantially rectangular patterns.

3. The gas burner of claim 2 wherein said plurality of gas ports are located in a first side portion of said unitary pan and said gas inlet tube is located in an opposite, second side portion of said unitary pan.

4. The gas burner of claim 3 wherein said gas inlet tube includes an air adjustment sleeve.

5. The gas burner of claim 3 wherein said gas inlet tube is of a fixed inlet size design.

6. The gas burner of claim 1 wherein said gas inlet tube includes an air adjustment sleeve.

7. The gas burner of claim 1 wherein said gas inlet tube is of a fixed inlet size design.

8. A gas burner for a fireplace comprising:

a unitary pan having a fold along a first edge, a crimped seam along a second, opposite edge, a first side seam between said first edge and said second, opposite edge and an opposite second side seam between said first edge and said second, opposite edge, said unitary pan having a hollow interior and defining a plurality of gas ports which are in flow communication with said hollow interior, said gas ports being positioned between said first edge and said second, opposite edge; and a gas inlet tube assembled to said unitary pan and being in flow communication with said hollow interior.

9. The gas burner of claim 8 wherein said plurality of gas ports are arranged in two spaced-apart substantially rectangular patterns.

10. The gas burner of claim 9 wherein said plurality of gas ports are located in a first side portion of said unitary pan and said gas inlet tube is located in an opposite, second side portion of said unitary pan.

11. The gas burner of claim 10 wherein said gas inlet tube includes an air adjustment sleeve.

12. The gas burner of claim 10 wherein said gas inlet tube is of a fixed inlet size design.

13. A method of fabricating a unitary pan for a gas burner for a fireplace comprises:

providing a panel of material with the desired dimensions;

machining said panel of material with a gas inlet tube hole and a plurality of gas ports;

forming a first long edge of said panel of material with a double bend geometry;

forming a second long edge of said panel of material with a single bend geometry;

folding said panel of material so as to bring said first and second long edges into alignment with each other;

crimping together said first and second long edges in order to create a sealed lip;

folding together a first pair of short edges;

folding together a second pair of short edges;

crimping together said first pair of short edges to create a sealed edge; and crimping together said second pair of short edges to create a sealed edge.

* * * * *